US006640714B1

(12) United States Patent
Papa

(10) Patent No.: US 6,640,714 B1
(45) Date of Patent: Nov. 4, 2003

(54) ADJUSTABLE BASE FOR SHIRT SCREEN-PRINTERS AND METHOD OF MOUNTING T-SHIRT

(75) Inventor: Frank J. Papa, Chester, NH (US)

(73) Assignee: The Gem Group, Inc., Lawrence, MA (US)

( * ) Notice: Subject to any disclaimer, the term of this patent is extended or adjusted under 35 U.S.C. 154(b) by 0 days.

(21) Appl. No.: 10/071,278

(22) Filed: Feb. 8, 2002

(51) Int. Cl.[7] ..... B41F 15/18; B41F 15/26
(52) U.S. Cl. ..... 101/474; 101/126
(58) Field of Search ..... 101/114, 126, 101/115, 407.1, 474; 223/61, 74, 120; 269/47, 48.1, 49, 50; 38/102.1, 102.5, 102.8

(56) References Cited

U.S. PATENT DOCUMENTS

| | | | | |
|---|---|---|---|---|
| 5,188,034 A | * | 2/1993 | Iaccino et al. | 101/474 |
| 5,199,353 A | * | 4/1993 | Szyszko | 101/474 |
| 5,247,885 A | * | 9/1993 | Iaccino et al. | 101/474 |
| 6,276,274 B1 | * | 8/2001 | Hoffman et al. | 101/474 |

* cited by examiner

*Primary Examiner*—Leslie J. Evanisko
(74) *Attorney, Agent, or Firm*—Cesari and McKenna, LLP; William A. Loginov

(57) ABSTRACT

A base or pallet that is variably adjustable along its width to specifically accommodate a wide range of differently sized pieces of clothing is provided. A main pallet base is flanked by a pair of extendable and retractable (movable) wings, along the underside thereof, that are constructed from a durable material and that extend simultaneously in opposing directions. In an illustrative embodiment, a movement-balancing mechanism, such as a rack-and-pinion assembly or pantograph, is used to extend and retract the wings at a similar rate. In this manner, pulling or pushing on one wing causes the other to move simultaneously. The wings are locked in place using a locking mechanism beneath the outer-facing side of the main base. The locking mechanism can be a block that applies friction to one of the rack sets of the rack-and-pinion assembly or other movement-balancing mechanism. The clothing piece, when loaded, draped from the side edges of the main base onto the wings, and whence over the side edges of the wings. The side edges are set so as to be adjacent to the sleeve seams, or other desired center-registration points, on the clothing piece.

20 Claims, 8 Drawing Sheets

ADJUSTABLE BASE FOR SHIRT SCREEN-PRINTERS AND METHOD OF MOUNTING T-SHIRT

BACKGROUND OF THE INVENTION

1. Field of the Invention

This invention relates to mechanisms for applying screen-printed decorations to clothing and more particularly to a base or pallet for supporting shirts in a screen-printing machine.

2. Background Information

Printed T-shirts and other clothing items remain a popular consumer item. Printed decorations, in the form of printed logos, patterns, and text, are often applied to shirts using a version of the well-known screen-printing technique. FIG. 1 shows a modem high-volume screen-printing device 100 that employs a rotating carousel 102 and a plurality of individual processing stations 104 arranged in a circle. The illustrated example shows a conventional commercially available screen-printing device having eighteen separate stations/rotary positions. The exemplary device is Challenger II™ available from M & R Sales and Service, Inc. of Glen Ellyn, Ill.

In general, the screen printing technique uses a stencil with perforations (e.g. a "screen") that match the pattern to be applied to the shirt. The shirt is mounted on a pallet (a rubberized, flat and heat-resistant surface) and passed under the pattern. A squeegee device above the pattern forces colored ink through the perforations, onto the shirt. The paint penetrates the pores of the cloth sufficiently to become permanent under normal wear, and is formulated with a viscosity and flow that prevents excessive bleeding through the cloth or under the screen. The applied paint is then dried at a drying station using a heater and the shirt is either removed or passed to another screen for application of further printing in, for example, another color. Each color is applied and dried in turn. An exemplary screen printing station 108 for the mechanism 100 is shown.

In the exemplary mechanism, a set of pallets 114 are each mounted on carousel arms 115 that extend radially outwardly from the central revolving hub 116. The pallets are advanced/indexed with respect to each of the stations 104 at a constant rate as they pass from loading to printing of the design 121 (one or several colors), and finally to drying and unloading (see unloading worker 117).

Initial placement of the item-to-be-printed on the pallet 114 is quite critical. In the illustrated example of a screen-printed T-shirt 112, if a shirt is not well centered, then the printing will appear crooked or offset, and the finished shirt is defective. Typically, a worker 109 (standing at the loading station 110) must quickly overlay and seat the shirt front 119 on the pallet 114 by hand in a manner that is accurately centered. Centering (e.g. "registration") typically entails the placement of the shirt so that the collar 120 is near the outer-facing edge 118 of the pallet, and the arm seams 122 are evenly spaced from the two opposing pallet side edges 124.

As shown, where the pallet is not well sized to the shirt, the arm seams 122 are draped at a significant distance DA from the pallet side edges 124. In many cases DA can be several inches (where large-sized shirts are printed). This increases the difficulty for the worker to properly judge the center of the shirt while he or she loads it onto the pallet—particularly at a desired operating speed, which can be 450–600 shirts per hour.

A variety of centering/registration mechanisms exist to ease the difficulty of properly loading pallets, but these often involve complex machine vision and optical solutions that are neither cost-effective nor easy to use, particularly by an unskilled operator. As such, manual solutions and the human eye are often preferred.

As shown in FIG. 2, one proven manual solution is to provide a set 150 of differently sized pallets representing desired increments of size change (from Small (S) to Extra-Extra-Extra-Large (XXXL), for example). These can be changed-out on each arm 115 as needed as represented by the arrows 160. Each arm includes an appropriate bracket and locking mechanism (not shown) for mounting and securing the pallet. Pallets are slid onto and off the arm (double arrow 161) when a change is made. However, maintaining multiple sets of differently sized pallets for each machine is costly (currently over $100 per pallet). It is also impractical to maintain a pallet for each size. In the example of FIG. 2, the set 150 consists of a small medium and large pallet 152, 154 and 156, respectively. These have respective widths W1, W2 and W3 that vary by several inches (for example W1=16 inches; W2=20 inches and W3=24 inches). However the use of multiple pallet sizes may still not guarantee close centering of all possible sizes. It is recognized that the width of the pallet should increase approximately ¾ to 1 inch for each increased shirt size. Therefore, certain sizes are simply loaded on a smaller-size pallet. This often leads to higher reject rates with these "in-between" sizes since the gap between the pallet side edges and the sleeve seams is increased beyond the desired minimum distance.

A significant disadvantage to using a plurality of differently sized pallets to accommodate various shirt sizes is that the change-out of a full set of pallets is typically time-consuming. Each time a size change is needed, the old pallets must be removed from their support beams and stacked or placed aside, the new pallets must then be unstacked and then mounted on the beams.

Accordingly, it is desirable to provide a pallet or base for screen-printing devices that accommodates a wide range of sizes without requiring differently sized pallet sets or a time-consuming change-out process. The pallet should fit readily on existing device supports and provide a rapidly adjustable mechanism for accommodating different sizes. The pallet should provide for easy and accessible adjustment and should exhibit desired weight and heat-dissipation characteristics so as to be compatible with existing devices and components. It should also enhance the operator's ability to rapidly and accurately center clothing pieces thereon.

SUMMARY OF THE INVENTION

This invention overcomes the disadvantages of the prior art by providing a base or pallet that is variably adjustable along its width to specifically accommodate a wide range of differently sized pieces of clothing. A main pallet base is flanked by a pair of extendable and retractable (movable) wings, along the underside thereof, that are constructed from a durable material and that extend simultaneously in opposing directions.

In an illustrative embodiment, a movement-balancing mechanism, such as a rack-and-pinion assembly or pantograph, is used to extend and retract the wings at a similar rate. In this manner, pulling or pushing on one wing causes the other to move simultaneously through the operatively connected rotation of the pinion assembly. The wings are locked in place using a locking mechanism beneath the outer-facing side of the main base. The locking mechanism can be a block that applies friction to one of the rack sets of the rack-and-pinion assembly or other movement-balancing mechanism. The clothing piece, when loaded, draped from the side edges of the main base onto the wings, and whence over the side edges of the wings. The side edges are set so as to be adjacent to the sleeve seams, or other desired center-registration points, on the clothing piece.

In an illustrative embodiment, the pair of movable wings are each sized and arranged to be retractable to a position fully beneath the underside so as to be free of extension beyond the opposing side edges. The wings are provided with graduations that are referenced against the respective main base side edges or another indicia. The graduations are chosen to relate to the sizes that are accommodated by the pallet so that adjustment to the wings can be made without needing to fit the shirt to the pallet first. To assist in guiding the wings linearly, a set of slots are provided in the wings that ride over guide screws and sleeves that are secured to the bottom of the main base. The wings can also be provided with enlarged central cutouts to reduce weight and heat buildup.

BRIEF DESCRIPTION OF THE DRAWINGS

The invention description below refers to the accompanying drawings, of which.

DETAILED DESCRIPTION OF AN ILLUSTRATIVE EMBODIMENT

Figure 3:
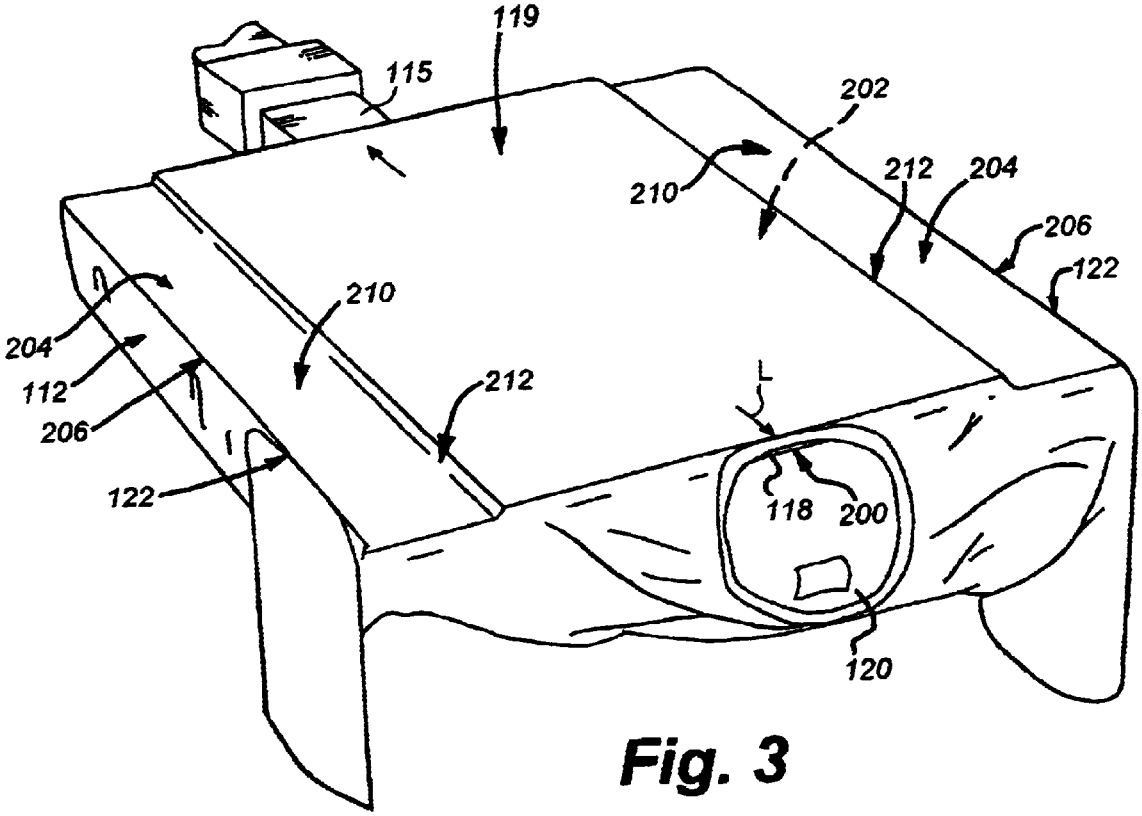
FIG. 3 is a perspective view of the adjustable base or pallet according to an illustrative embodiment of this invention showing a shirt-to-be-printed centered thereon.

FIG. 3 shows a base or "pallet" 200 for supporting an item-to-be-printed (in this example the T-shirt 112). The shirt front 119 is laid over the central base of the pallet. In this example, the central base comprises a metallic substrate formed from a sturdy material such as aluminum sheet, covered by a semi-rigid, heat-resistant material such as nitrile rubber. The rubber and any intervening layers can be adhered to the aluminum substrate using appropriate adhesives. On either side of the central base 202 is mounted side wings 204 that extend the outermost side edges 206 of the overall pallet structure so that these edges are approximately aligned with the seams 122 of the sleeves. Note that the collar 120 is aligned with the front edge 118. The length L of the pallet is sufficient so that the entire printable area of the shirt front 119 is supported on the flat central base 202. In one embodiment the length L is approximately 22 inches. The wings 204 thus allow the side edges 206 to be placed in close proximity of the sleeve seams 122. Naturally, the principles described herein can be applied to any appropriate registration point on the item-to-be-printed that enables accurate registration of the item with respect to the pallet. In this example, the sleeve seams are essentially symmetrical about the shirt front 119. Thus, by placing the edges 206 in relatively close proximity to the sleeve seams 122, the worker may quickly and accurately mount the shirt on the pallet 200 without significant effort in estimating the centering. This results from the fact that, the smaller the distance, the less approximation the human eye and brain require to accurately gauge a relative distance.

Figure 4:
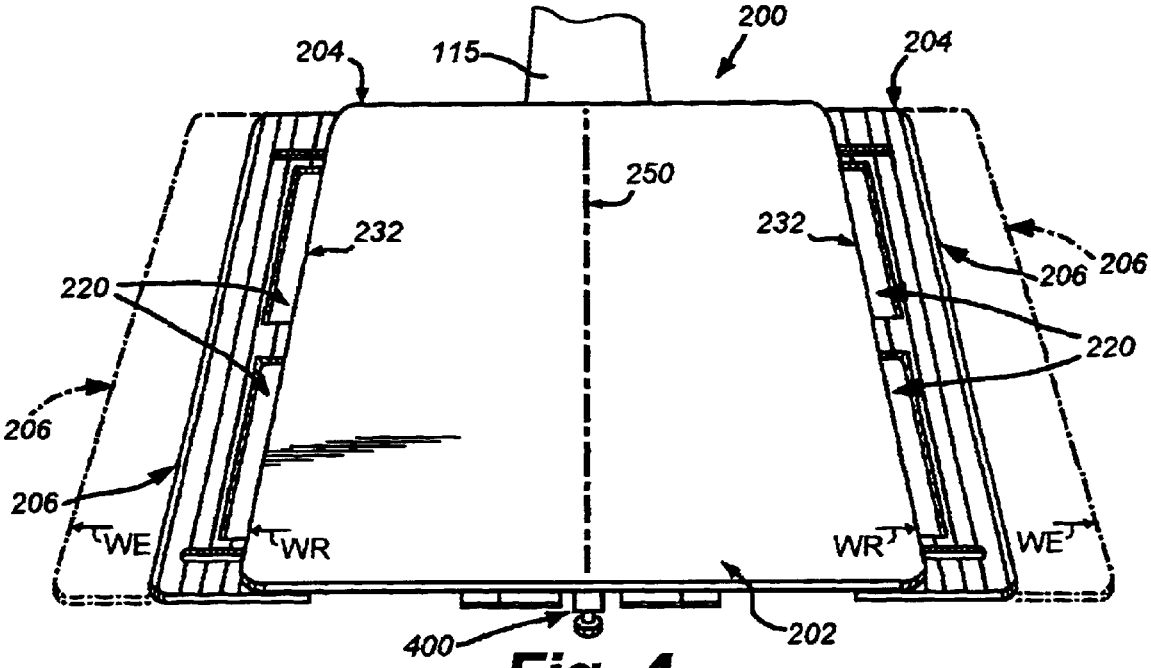
FIG. 4 is a perspective view of the adjustable base or pallet of FIG. 3 in an unloaded state.

FIG. 4 shows the pallet 200 in further detail, with the shirt removed therefrom. The wings 204 are mounted beneath the central base 202 of the pallet, along its underside. As shown generally in FIGS. 3 and 5, this causes the outer portions 210 of the shirtfront to droop onto the wings 204 with respect to the central base 202. In most instances, this droop is potentially advantageous, as it further accentuates the relative centering of the shirt and generates a desirable tension along the shirtfront 119. This tension is partly due to the downforce generated on each side of the shirtfront by the step edges 212 between the wings 204 and the central base 202. This tension further assists the worker by insuring that the shirt is accurately and flatly placed on the central base of pallet for subsequent printing. Note that while printing of the shirt front is shown, the techniques described herein can also be applied to the shirt back or any other printable surface.

In this embodiment, the wings 204 are constructed from solid aluminum alloy stock having a thickness of between approximately ⅛ and 5⁄16 inch. Because weight should generally be maintained at a minimum in order to prevent overloading of the machine's arm 115, each wing 204 is provided with central cutouts 220 (FIG. 4). The cutouts are sized so as to reduce the overall weight of the wings to an acceptable level without overly compromising the structural integrity of each wing, as well as enhance heat dissipation (as the drying process may generate significant heat). In general, the wings do not need to support substantial weight, as the central base 202 is the area upon which all printing activity occurs. In fact, one further advantage of the depressed location of the wings 204 is that they draw unprinted sections of the shirtfront out of contact with the printer and other components. In one embodiment the cutouts 220 are sized approximately 6 inches in length by 3½ inches in width.

Figure 1:
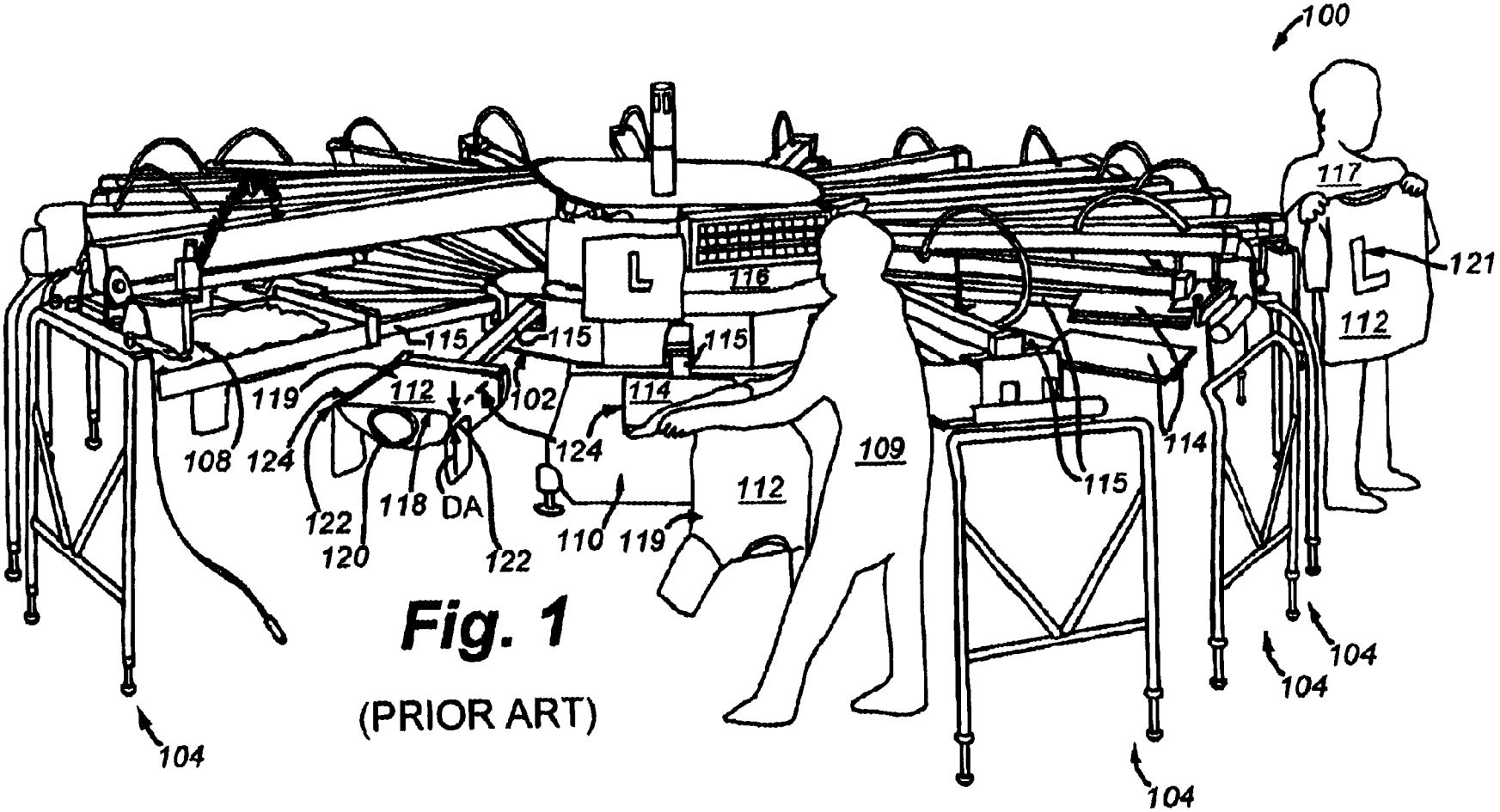
Fig. 1 (PRIOR ART)
FIG. 1, already described, is a perspective view of a carousel screen-printing mechanism using bases or pallets for mounting items-to-be-printed according to the prior art.
Figure 2:
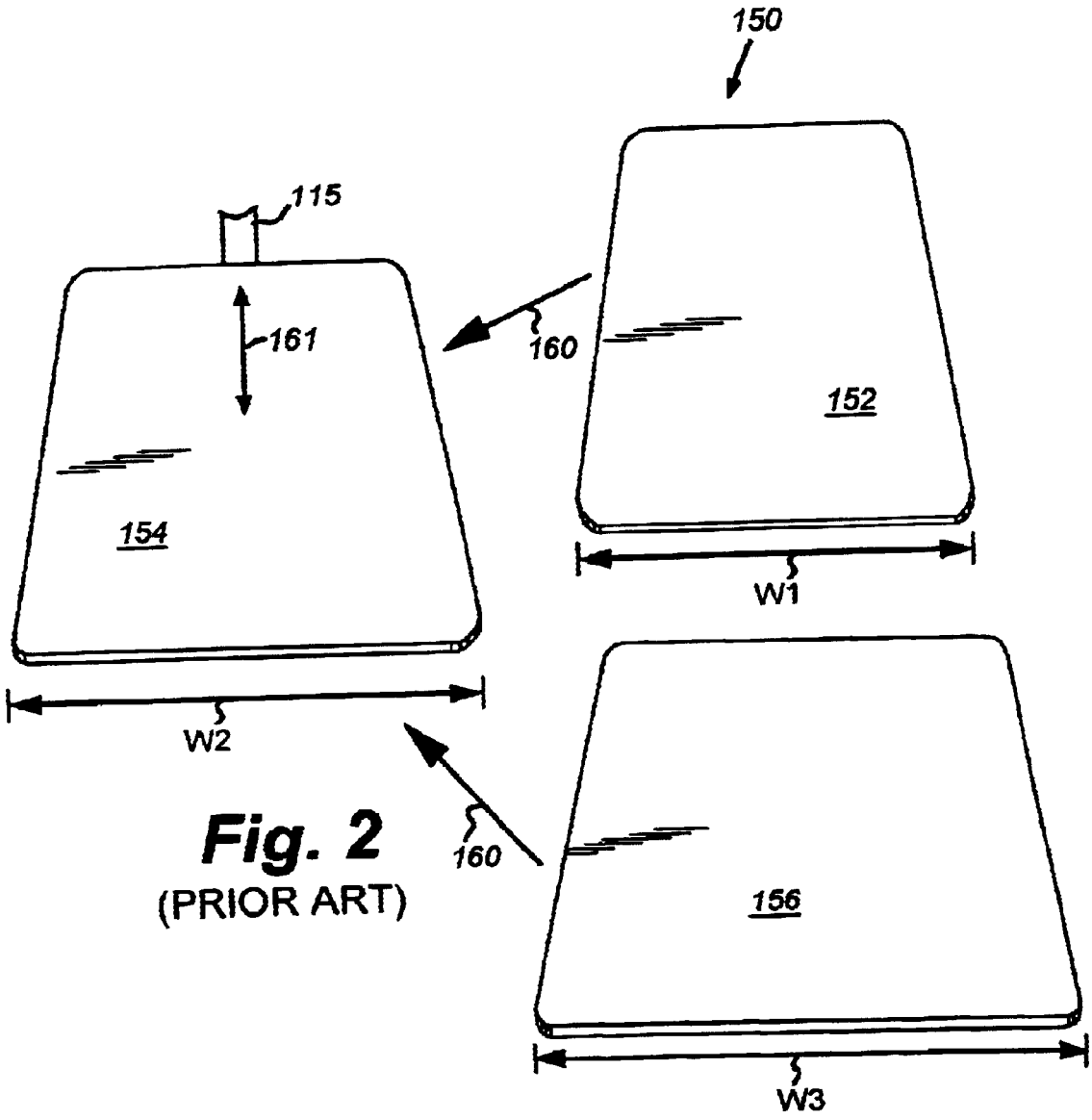
Fig. 2 (PRIOR ART)
FIG. 2, already, described, is a perspective view of a set of differently sized bases or pallets for use with the mechanism of FIG. 1 to accommodate differently sized items-to-be-printed.
Figure 5:
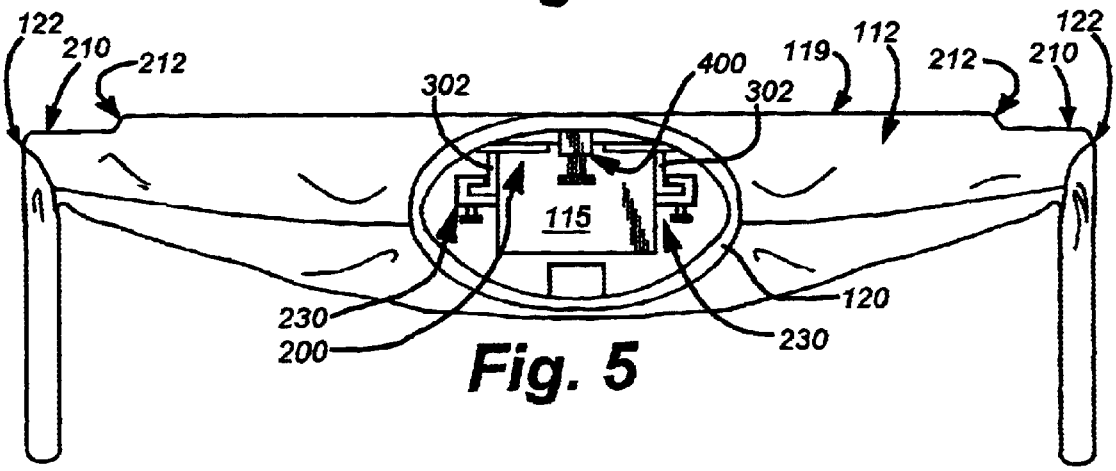
FIG. 5 is a front end view of the adjustable base or pallet of FIG. 3.

As shown generally in FIG. 5, the arm includes a mounting bracket assembly 230 that allows the pallet to be slid onto and off of the arm, and to be locked in place in the desired mounting position. Appropriate through-pins, turn screws or other mechanisms can be employed. As noted above, one advantage of the adjustable pallet design, according to this embodiment, is that the pallet may remain mounted for a longer period as it is easily accommodated to all different sizes of shirts. This eliminates the need for a set of multiple pallets in assorted sizes—such as shown generally in FIG. 2. In general, pallets may only require removal for cleaning, maintenance and/or replacement. As will be described further below, the range of movement of the wings is between a fully retracted position that is flush with the side edges 232 of the central base 202 and a fully extended position shown in phantom.

Figure 6:
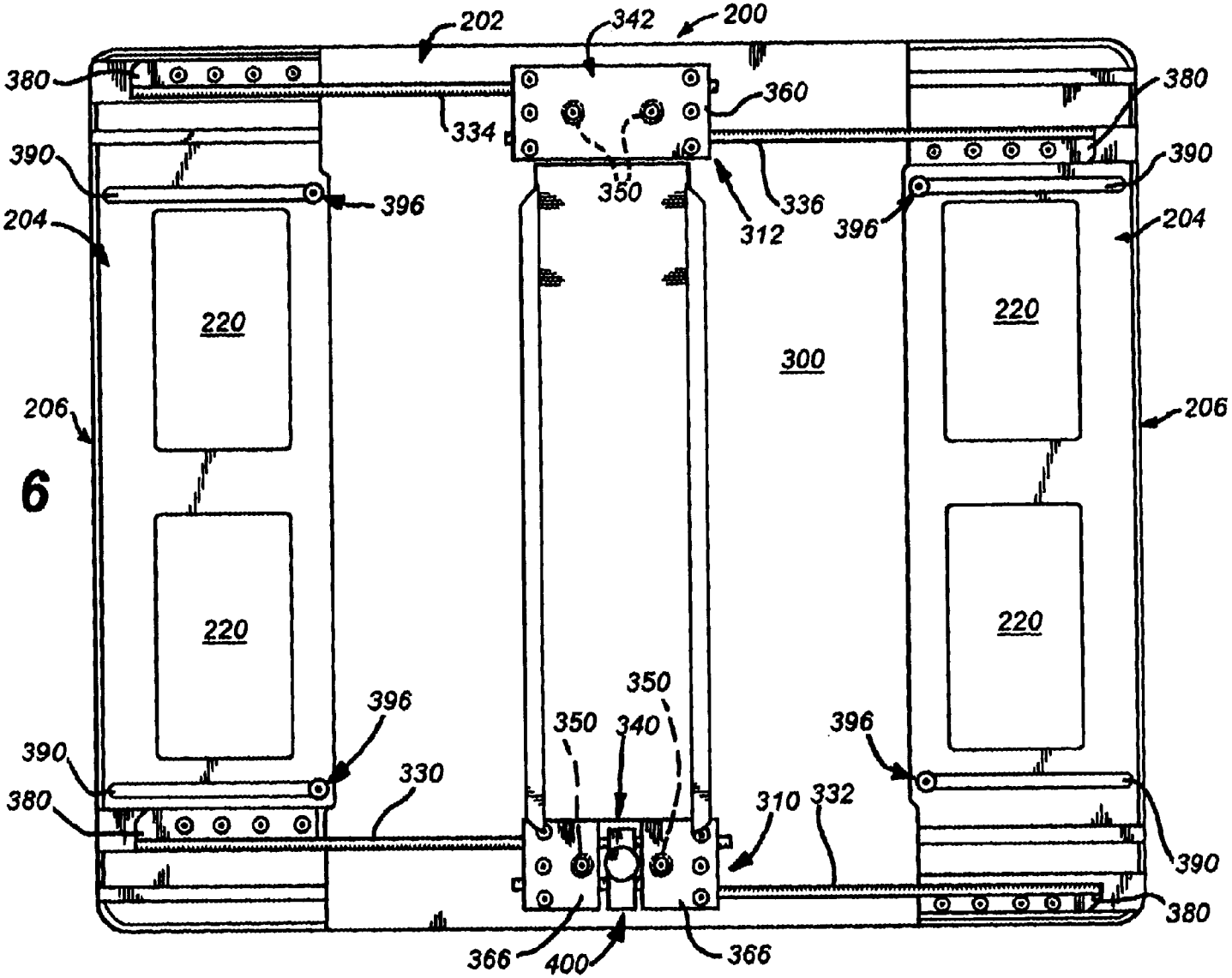
FIG. 6 is a bottom plan view of the adjustable base or pallet of FIG. 3 detailing the adjustment mechanism.
Figure 7:
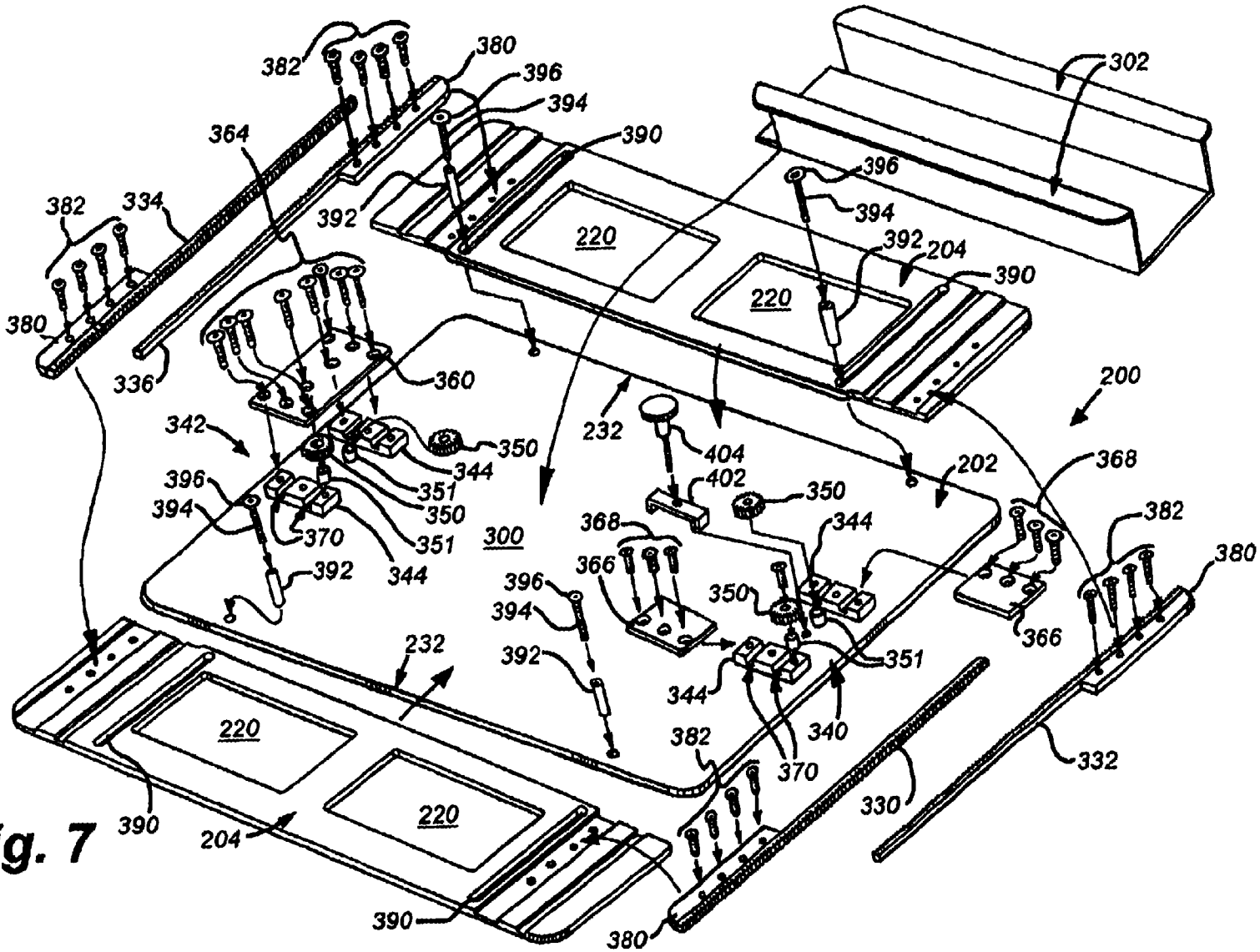
FIG. 7 is an exploded perspective view of the bottom of the adjustable base or pallet of FIG. 3.
Figure 8:
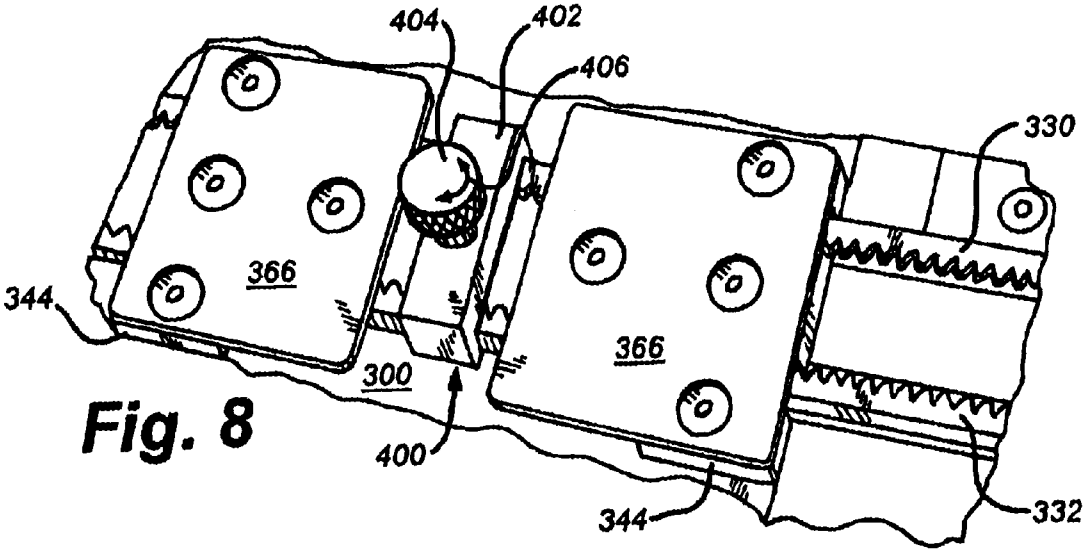
FIG. 8 is a more-detailed fragmentary perspective view of the bottom locking assembly for the adjustment mechanism of the adjustable base or pallet of FIG. 3.

In one embodiment, the fully retracted position results in a minimum pallet width WR of approximately 16 inches and the fully extended position results in a maximum width WE of more than 24 inches. With further reference to FIGS. 6–8, the mechanism for extending and retracting the wings 204 is detailed further. In general, the mechanism according to an illustrative embodiment allows each wing to be extended or retracted in equal distance with respect to the base 202. This guarantees that the outer side edges 206 are always equally spaced from the centerline 250 (FIG. 4) of the pallet structure—and that the location of the centerline remains constant. Moreover, this mechanism enables the wings to be extended or retracted by applying pressure to only one of the two wings, thus increasing ease of adjustment for the worker.

Referring now to the underside of the pallet 200, as shown in FIGS. 6–8, the aluminum substrate 300 carries the arm-mounting rail 302, that is typically tack-welded or otherwise adhered to the substrate 300. Adjacent to each end of the rail 302 (front and rear) are respective front and rear movement-balancing mechanisms 310 and 312. The rail 302 is arranged with respect to the mechanisms 310 and 312 so that the machine arm (115) passes over (at least) the rear mechanism 312 without interference from the rear mechanism. This can be accomplished by constructing the mechanism 312 with a sufficiently low profile and/or by arranging the mounting rail 302 so that the arm passes above the mechanism 312. In one embodiment, the rear mechanism 312 is approximately ½–3/4 inch proud of the underside.

According to an illustrative embodiment, the front and rear movement-balancing mechanisms 310 and 312 each comprise a pair of gear racks 330, 332 and 334, 336 (respectively). The front gear racks 330 and 332 are mounted so that their teeth face each other. Likewise, the rear gear racks 334 and 336 are also mounted so that their teeth face each other. The front gear racks 330 and 332 pass through a front guide assembly 340. Similarly, the rear gear racks 334 and 336 pass through a rear guide assembly 342. As further shown in FIG. 7, each guide assembly 340, 342 includes a respective pair of base blocks 344. Between the base blocks are positioned a respective pair of pinion gears 350, respectively, each mounted on a journal bearing/spacer 351 and secured by an appropriate screw. This mounting arrangement allows the gears to rotate freely without binding The rear guide assembly 342 includes a one-piece top plate 360 that covers the pinion gears 350 and blocks 344. The plate has holes for receiving a set of screws 364 that secure the plate through aligned holes in the guide blocks 344, and whence into the substrate 300 of the central base 202. These screws also secure the gears 350 and their journals 351. Similarly, a pair of top plates 366 are provided at opposing ends of the front guide assembly 340. Appropriate screw sets 368 are used to secure these plates 366, guide blocks 344 and gears 350. Each of the guide blocks 344 includes grooves 370 that are sized and arranged to capture a respective gear rack 330, 332, 334 and 336 between the blocks 344 and the respective covers 360, 366. In this position, the oppositely facing teeth of each gear rack pair (front and rear) engage the respective pinion gear pair 350. Note that the pinion gears do not engage each other, but rather engage only the opposing racks. In an alternate embodiment, a single pinion gear can be used for each assembly 340 and 342. In any case, the racks engage diametrically opposed points on the pinion gear(s).

The interaction of the pinion gears and racks causes—when one wing is moved inwardly or outwardly—the other wing to move simultaneously in an equal amount in the opposite direction. In other words rightward movement of one wing causes opposite, leftward movement of the other wing, and vice versa. The gears tile the linear movement of one wing to linear movement of the other via rotation therebetween. This results in the desired simultaneous extension or retraction of the wings. Note that the gear racks include mounting plates 380 sized and arranged to reside in corresponding recesses within each of the wings. Sets of screws 382, or similar fasteners, are used to secure the plates 380 to their respective wings.

Each of the wings 204 also includes a pair of 5½-inch (for example) guide slots 390 on each end, near its front and rear edges, respectively. The guide slots secure the wings against the underside of the central base 202 through interaction with respective spacers 392 and screws 394 that are secured into the substrate 300 of the base 202. The screws 394 include heads 396 that are sized and located to maintain the wings 204 flushly against the underside of the base 202 without excessive play. The screws 394 also serve as extension/retraction stops for the wings, limiting the fully extended and fully retracted positions of the wings. This is because slots are accurately sized so that the spacers 392 engage opposing ends of the slots at the opposing limits of wing travel.

Note that in a fully extended position, such as shown in FIG. 6, the front racks 330, 332 and rear racks 334, 336 each extend fully through their respective guide assembly 340 and 342. This ensures that both pinion gears 350 in each assembly 340, 342 are engaged by each rack at all positions of extension and/or retraction. Also, it further ensures that each opposing guide block 344 in a given assembly 340, 342 continually encloses a given rack, thereby helping to prevent misalignment (e.g. downward bending) of each wing 204 with respect to the central base 202.

The front guide assembly 340 is divided, with a central gap between plates 366, to make room for a locking mechanism 400 according to an embodiment of this invention. The locking mechanism 400 is shown in further detail in FIG. 8. This locking mechanism 400 includes a locking block 402 and a thumbscrew 404. The thumbscrew 404 is threaded into the substrate 300 of the central base 202. When the thumbscrew is rotated (double arrow 406) in a tightening direction, it causes the locking block 402 to bear down onto the racks 330 and 332, thus generating locking friction that restrains linear movement of the racks. Likewise, when the thumbscrew 404 is loosened, the locking block 402 exerts minimal friction on the racks 330, 332, thus allowing them to be moved linearly to the appropriate adjustment position. A variety of other locking mechanisms using turn screws or other devices can be employed. For example, according to an alternate embodiment (not shown), a rotationally stationary gear can be moved in an axial direction in-between the racks, thus locking them in an appropriate location. Locks that apply pressure directly to the pinion gears can also be used.

Figure 9:
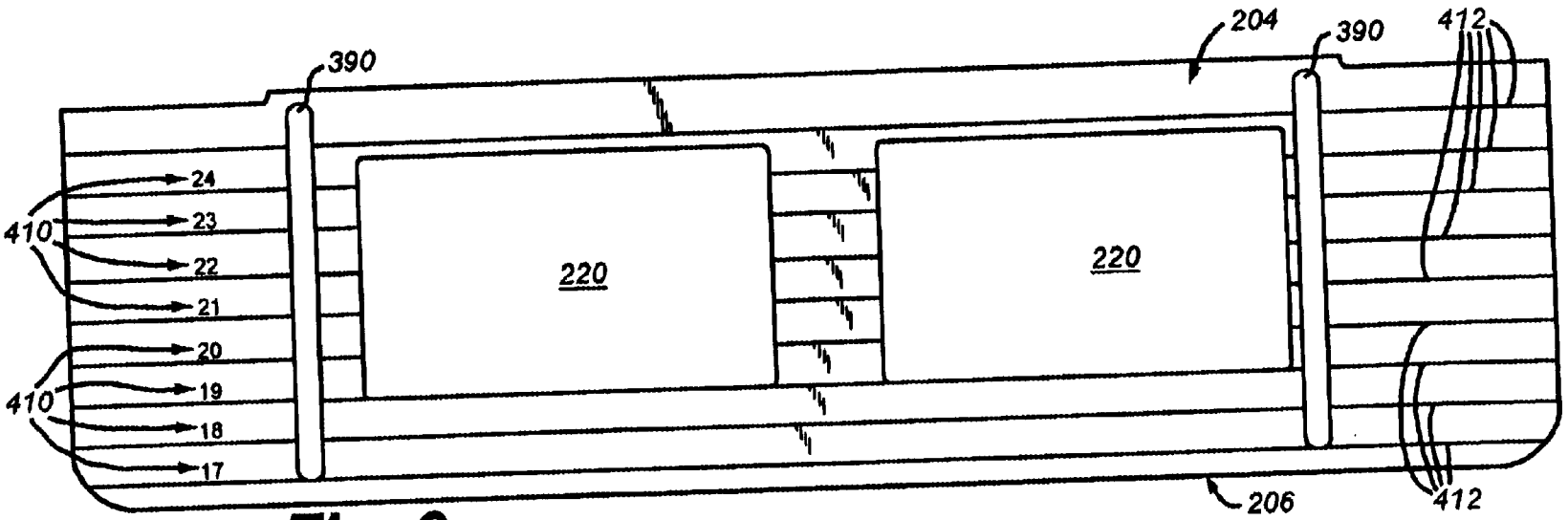
FIG. 9 is a top plan view of one of the pair of movable side wings for the adjustable base or pallet of FIG. 3.

FIG. 9 shows the top surface of one of the wings 204 according to an embodiment of this invention. Note that a series of indicia.410 that represent total inches of extension are inscribed with respect to each of the series of lines 412 on the top surface of the wing 204. When each line 412 is brought into alignment with the respective overlying side edge 232 of the central base 202 (see FIG. 4), the indicated width of extension has been achieved. Since each indicium represents simultaneous movement of both opposing wings 204, the distance between lines 412 is approximately ½ inch (e.g. one-half the total indicated distance).

Figure 10:
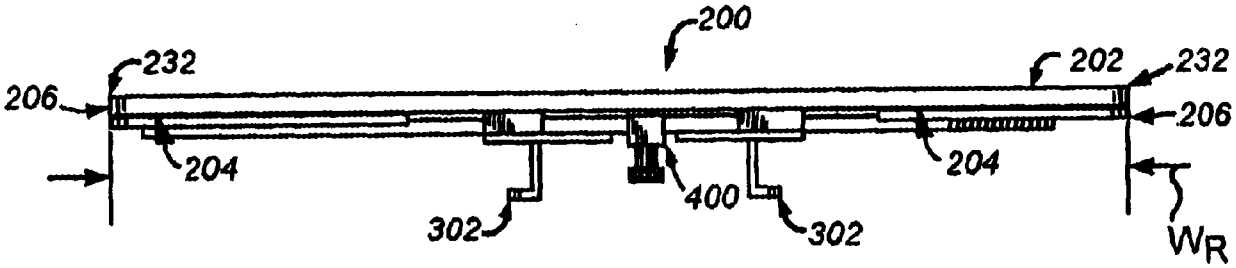
FIGS. 10 and 11 are front end views of the adjustable base or pallet of FIG. 3 in a fully retracted and fully extended view, respectively.
Figure 11:
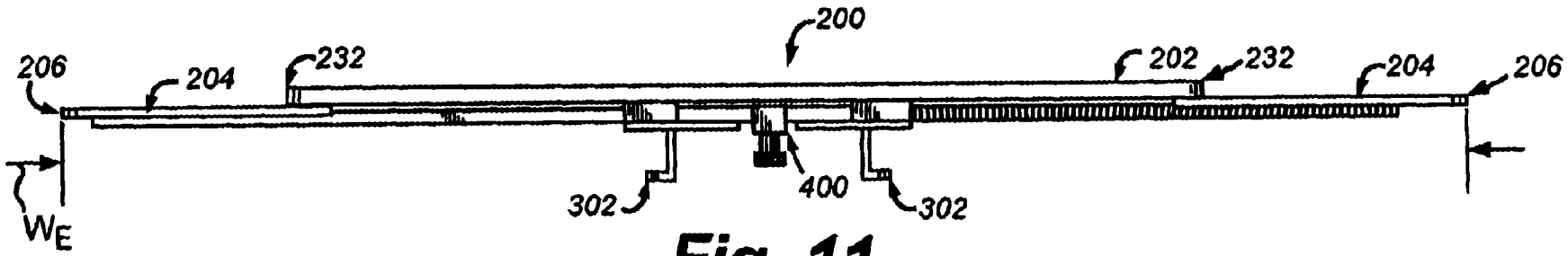

Finally, FIG. 10 shows a minimal extension for the pallet in which the wings' outermost side edges 206 are essentially flush with the overlying central base side edges 232. This creates the narrowest profile for the smallest anticipated item-to-be-printed. Alternatively, FIG. 11 shows a maximum extension in which the wings 204 are fully extended with their outermost side edges 206 at a maximum spacing from the central base side edges 232. This setting anticipates the largest expected item-to-be-printed.

Note that is expressly contemplated that other types of movement-balancing assemblies and mechanisms can be employed according to this invention. For example, instead of a gear rack and pinion arrangement, a scissors-like pantograph assembly (not shown) that interconnects each of the wings to central pivots on the base underside can be employed in an alternate embodiment.

It should be clear from the above description that an adjustable pallet according to this invention enables the most-accurate fit for a given item-to-be-printed to be achieved by a worker quickly and easily. This further ensures the proper alignment of the item with respect to the pallet, using visual queues on the item that are closely located with respect to the pallets adjustable edges. Where previously, an approximately sized pallet was mounted at an average cost of 5–10 minutes per pallet, the exact size required for an item can be attained in a few seconds per pallet according to the present invention.

The foregoing has been a detailed description of an illustrative embodiment of the invention. Various modifications and additions can be made without departing form the spirit and scope of the invention. For example, while a high-volume, multi-station screen-printing machine is shown in connection with the invention, it is expressly contemplated that the pallet herein can be used in conjunction with a machine having fewer separate stations, or even a single-station machine and still achieve the desirable advantages described herein. Likewise, while a machine having a carousel layout is shown, the machine utilizing a pallet according to this invention can have any acceptable station layout, such point-to-point production line arrangement. Likewise, the materials described for various components and fastener choices are highly variable. In addition, the adjustable size range described herein is highly variable, and can be modified to accommodate the particular items-to-be-printed. Further, while a movement-balancing mechanism having front and rear gear racks and pinions is shown and described, it is expressly contemplated that a single movement-balancing assembly can be provided appropriate guides to prevent skew. For example, a single gear rack and pinion with an opposing nontoothed slide assembly can be employed. Finally, while a removable pallet is shown, the teachings herein can be applied to machines having a pallet that is, essentially, permanently fixed to the machine. Accordingly, this description is meant to be taken only by way of example, and not to otherwise limit the scope of the invention.

What is claimed is:

1. An adjustable base for receiving a clothing piece on a screen printing device comprising:

a main base having a surface adapted to support a portion of the clothing piece to be printed upon, the main base including an outer-facing edge and opposing side edges;

a pair of movable wings mounted to an underside of the main base and extending linearly away from each other to a predetermined adjustment distance so as to relate to a desired size of the clothing piece; and a movement-balancing mechanism, operatively connected to each of the pair of movable wings and to the underside of the main base, adapted to cause a first wing of the pair of movable wings to extend or retract a similar amount that a second of the pair of movable wings is caused to extend or retract, respectively.

2. The adjustable base as set forth in claim 1 wherein the pair of movable wings are each sized and arranged to be retractable to a position fully beneath the underside so as to be free of extension beyond the opposing side edges.

3. The adjustable base as set forth in claim 1 wherein the movement-balancing mechanism comprises a rack-and-pinion assembly.

4. The adjustable base as set forth in claim 3 wherein the rack-and-pinion assembly includes a first rack set having a first rack mounted to the first wing and a second rack mounted to the second wing, wherein teeth of each of the first rack and the second rack face each other, and a first pinion gear assembly engaging the teeth of each of the first rack and the second rack.

5. The adjustable base as set forth in claim 4 wherein the rack-and-pinion assembly includes a second rack set having a first rack mounted to the first wing and a second rack mounted to the second wing, wherein teeth of each of the first rack and the second rack face each other, and a second pinion gear assembly engaging the teeth of each of the first rack and the second rack of the second rack set, and wherein the first rack set and first pinion gear assembly is located adjacent to the outer-facing edge and the second rack and second pinion gear assembly is located adjacent to an inner-facing edge of the main base opposite the outer-facing edge.

6. The adjustable base as set forth in claim 5 further comprising a locking block assembly located along the underside adjacent to the outer-facing edge adapted to selectively apply pressure to the rack to lock the rack so as to maintain the pair of movable wings at the predetermined adjustment distance.

7. The adjustable base as set forth in claim 3 wherein each of the pair of movable wings is constructed from aluminum.

8. The adjustable base as set forth in claim 1 further comprising a locking block assembly located along the underside adjacent to the outer-facing edge adapted to selectively apply pressure to the movement-balancing mechanism so as to maintain the pair of movable wings at the predetermined adjustment distance.

9. The adjustable base as set forth in claim 8 wherein the locking block assembly includes a friction-applying block and a turn screw mounted to the underside that moves the locking block into pressurable contact with the movement-balancing mechanism.

10. An adjustable base for supporting an item-to-be-printed with respect to a screen-printing device, the item-to-be-printed having a pair of opposing arm hole seams and being sized in a range of sizes from a minimum size to a maximum size each of the sizes defining a predetermined distance between arm hole seams, the adjustable base comprising:

a central base section that supports a printable area on the item to be printed the printable area being defined between the pair of opposing arm hole seams on the item-to-be printed; and a pair of side wings mounted on each of opposing sides of the central base section, the side wings being extendable and retractable in a linear direction with respect to adjacent side edges of the central base section and with respect to each other so that a desired overall width for supporting the item-to-be-printed is attained, and wherein each of the side wings includes a respective outer side edge that is adapted to be aligned with an adjacent one of the arm hole seams when the item to be printed is supported on the base.

11. The adjustable base as set forth in claim 10 wherein the overall width is sized and arranged to receive a T-shirt, a minimum overall width being adapted to receive a smallest sized T-shirt and a maximum overall width being adapted to receive a largest sized T-shirt with each of opposing arm seams thereof being approximately adjacent to a respective outermost side edge of each of the side wings.

12. The adjustable base as set forth in claim 10 further comprising a movement-balancing mechanism operatively connected to the central base section each of the side wings, adapted to cause each the side wings to extend from and retract toward, respectively, the central base section an equal distance.

13. The adjustable base as set forth in claim 12 wherein each of the side wings includes distance graduations that indicate a degree of extension with respect to the central base section.

14. The adjustable base as set forth in claim 13 wherein each of the side wings comprises a metallic plate having cutouts to reduce weight and dissipate heat mounted with respect to the underside of the central base section.

15. The adjustable base as set forth in claim 12 wherein the movement-balancing mechanism includes a gear rack attached to each of the side wings and a pinion that operatively connects each gear rack to cause simultaneous movement of each of the gear racks.

16. The adjustable base as set forth in claim 15 further comprising a locking mechanism that applies holding pressure to the gear rack of each of the side wings, respectively.

17. A method for mounting a T-shirt on a support base with respect to a screen-printing device comprising:

selecting a T-shirt-to-be-printed having a predetermined size;

moving each of a pair of opposing side wings of the support base with respect to a fixed central base area of the support base so that an overall width corresponding to the predetermined size is attained; and passing an open end of the T-shirt over a free end of the support base so as to center a printable area of the T-shirt upon the central base area, including aligning arm seams of the T-shirt with respect to outermost side edges of each of the opposing side wings, respectively.

18. The method as set forth in claim 17 wherein the step of passing includes registering a collar of the shirt against the free end of the support base.

19. The method as set forth in claim 17 wherein the step of moving includes moving one of the opposing side wings and causing another of the opposing side wings to move an equal amount in an opposing direction under action of a movement-balancing mechanism so as to maintain a constant centerline location between each outermost side edge.

20. The method as set forth in claim 19 further comprising locking the movement-balancing mechanism to maintain the overall width.

* * * * *